US010602853B2

(12) United States Patent
Yang

(10) Patent No.: US 10,602,853 B2
(45) Date of Patent: Mar. 31, 2020

(54) BENCH

(71) Applicant: Lei Yang, City of Industry, CA (US)

(72) Inventor: Lei Yang, City of Industry, CA (US)

( * ) Notice: Subject to any disclaimer, the term of this patent is extended or adjusted under 35 U.S.C. 154(b) by 0 days.

(21) Appl. No.: 15/879,423

(22) Filed: Jan. 24, 2018

(65) Prior Publication Data

US 2018/0146790 A1 May 31, 2018

Related U.S. Application Data

(63) Continuation of application No. 14/839,929, filed on Aug. 29, 2015, now Pat. No. 10,165,866.

(51) Int. Cl.

| | |
|---|---|
| ***A47C 19/22*** | (2006.01) |
| ***A47C 11/00*** | (2006.01) |
| ***A47C 19/02*** | (2006.01) |

(52) U.S. Cl.

CPC ..... *A47C 19/22* (2013.01); *A47C 11/00* (2013.01); *A47C 19/022* (2013.01)

(58) Field of Classification Search

CPC ..... A47C 19/22; A47C 11/00; A47C 7/18; A47C 7/24; A47C 19/25

USPC ..... 297/232, 443, 445.1, 452.48, 452.58, 297/452.59

See application file for complete search history.

(56) References Cited

U.S. PATENT DOCUMENTS

| | | | | | |
|---|---|---|---|---|---|
| 1,392,242 | A * | 9/1921 | Albergoli | F16B 12/48 | 297/445.1 |
| 2,864,438 | A * | 12/1958 | Levine | A47C 4/02 | 297/411.44 |
| 3,093,410 | A * | 6/1963 | Wilson | A47C 17/37 | 297/119 |
| 3,278,229 | A * | 10/1966 | Bates | A47C 3/34 | 297/344.18 |
| 3,745,596 | A * | 7/1973 | Copeland | A47C 17/86 | 5/308 |
| 4,913,496 | A * | 4/1990 | Oke | A47C 3/04 | 297/297 |
| 6,135,562 | A * | 10/2000 | Infanti | A47C 7/40 | 297/440.14 |
| 2006/0282945 | A1* | 12/2006 | Gallawa | A47B 83/04 | 5/2.1 |
| 2013/0020839 | A1* | 1/2013 | Scott Groveveldt | A47C 4/04 | 297/16.1 |
| 2014/0310871 | A1* | 10/2014 | Nassif | A47C 17/14 | 5/12.2 |

* cited by examiner

*Primary Examiner* — Brian E Glessner
*Assistant Examiner* — Adam G Barlow
(74) *Attorney, Agent, or Firm* — Raymond Y. Chan; David and Raymond Patent Firm

(57) ABSTRACT

A bench for a bed frame having a headboard includes a base frame and a back frame. The base frame includes a seat frame and a leg frame downwardly extended from the seat frame. The back frame is upwardly extended from the seat frame, wherein a shape of the back frame matches with a shape of the headboard of the bed frame. In particular, an ornamental design of the back frame matches with an ornamental design of the headboard of the bed frame, so as to enhance an aesthetic appearance of the bench which serves as a bedroom bench.

5 Claims, 4 Drawing Sheets

BENCH

CROSS REFERENCE OF RELATED APPLICATION

This is a Continuation application that claims the benefit of priority under 35 U.S.C. § 120 to a non-provisional application, application Ser. No. 14/839,929, filed Aug. 29, 2015. The afore-mentioned patent application is hereby incorporated by reference in its entirety.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to furniture, and more particularly to a bench, which comprises a seat frame and a back frame adapted for matching with a headboard of a bed frame.

Description of Related Arts

A bench is a piece of furniture for outdoor or indoor use. Generally speaking, the indoor bench can serve as a bedroom bench placed in a bedroom or serve as an entryway bench or storage bench for providing an additional storage. The common problem for the indoor bench is that it has no back frame.

Especially for the bedroom bench, it is often placed at a foot end of the bed frame which comprises a headboard. Since the bench does not have any back frame, the bench is not designed for the user to sit comfortably. In other words, the bench will become a non-functional decorative furniture or an end table for the user to place the bed accessories thereon. The conventional bed frame further comprises a footboard, wherein when the bedroom bench is placed to align with the footboard of the bed frame, the footboard of the bed frame may block by the bench. It is awful to place the bench adjacent to the footboard of the bed frame that the bench does not match with the overall appearance of the bed frame.

SUMMARY OF THE PRESENT INVENTION

The invention is advantageous in that it provides a bench, which comprises a seat frame and a back frame adapted for matching with a headboard of a bed frame.

Another advantage of the invention is to provide a bench, wherein the back frame enhances the practical use of the bench, such that the user is able to sit on the bench comfortably.

Another advantage of the invention is to provide a bench, which can be incorporated with a bed frame to match with a headboard of the bed. In particular, an ornamental design of the back frame matches with an ornamental design of the headboard of the bed frame so as to enhance an aesthetic appearance of the bench.

Another advantage of the invention is to provide a bench, wherein the furniture manufacturer is able to replace any ornamental design of the back frame to couple at the base frame in order to match the ornamental design of the back frame with the ornamental design of the headboard of the bed frame.

Another advantage of the invention is to provide a bench, which does not require to alter the original structural design of the bench, so as to minimize the manufacturing cost of the bench incorporating with the back frame.

Another advantage of the invention is to provide a bench, wherein the assembling operation of the bench is simple and easy that the user is able to self-assemble the bench.

Another advantage of the invention is to provide a bench, wherein no expensive or complicated structure is required to employ in the present invention in order to achieve the above mentioned objects. Therefore, the present invention successfully provides an economic and efficient solution for providing an additional seating configuration for the bench to match with the bed frame.

Additional advantages and features of the invention will become apparent from the description which follows, and may be realized by means of the instrumentalities and combinations particular point out in the appended claims.

According to the present invention, the foregoing and other objects and advantages are attained by a bench for a bed frame having a headboard includes a base frame and a back frame. The base frame includes a seat frame and a leg frame downwardly extended from the seat frame. The back frame is upwardly extended from the seat frame, wherein a shape of the back frame matches with a shape of the headboard of the bed frame. In particular, an ornamental design of the back frame matches with an ornamental design of the headboard of the bed frame, so as to enhance an aesthetic appearance of the bench which serves as a bedroom bench.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
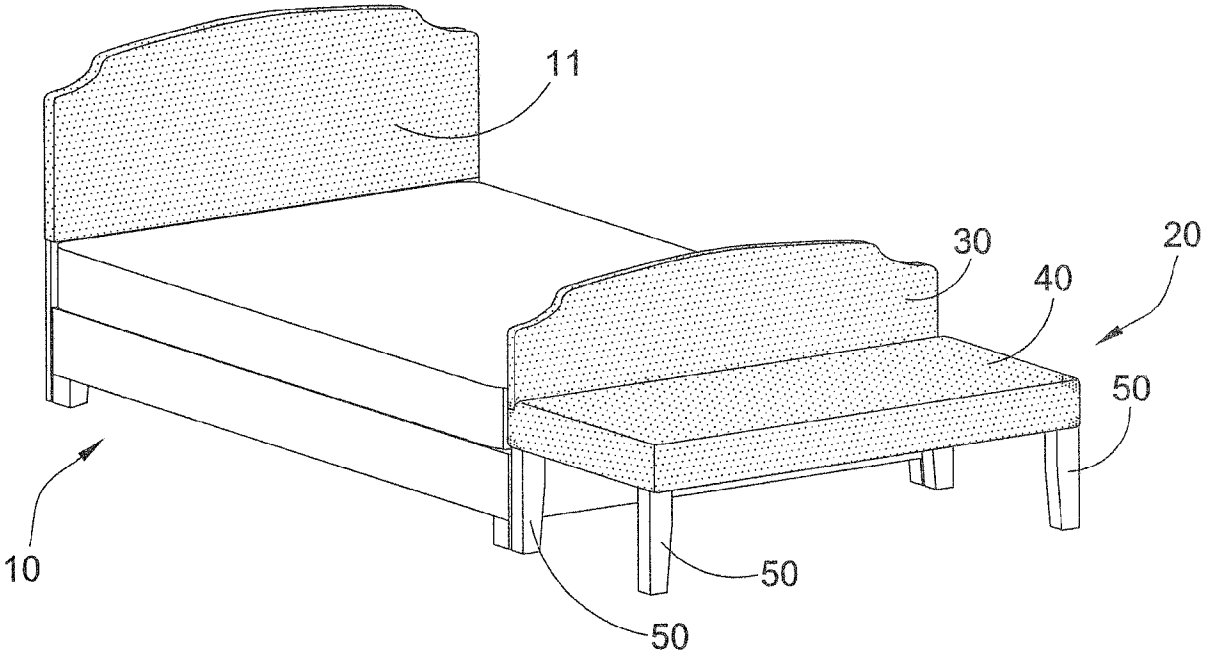
FIG. 1 is a perspective view of a bench incorporating with a bed frame according to a preferred embodiment of the present invention.
Figure 2:
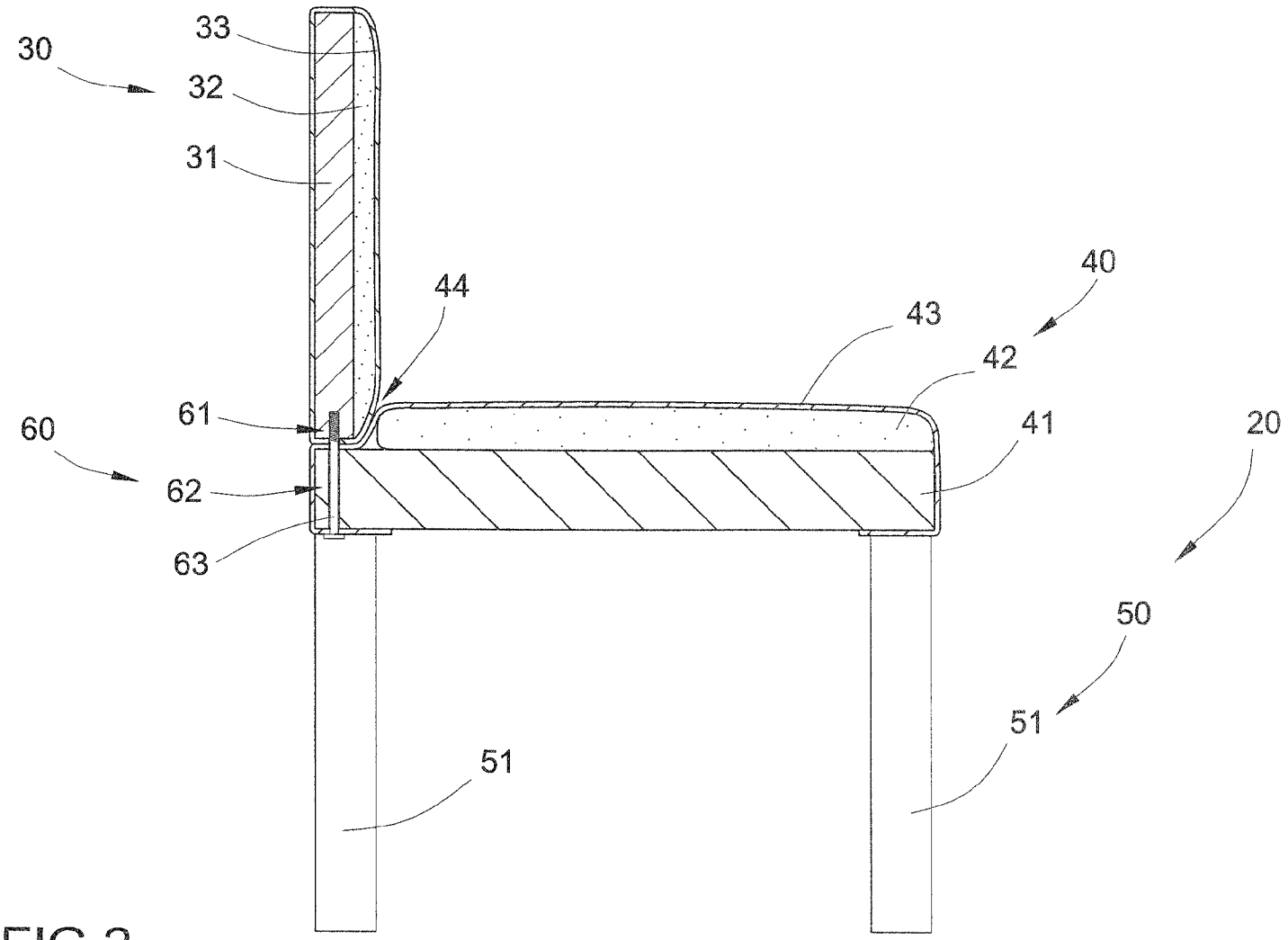
FIG. 2 is a sectional view of the bench according to the above preferred embodiment of the present invention.

Referring to FIGS. 1 and 2 of the drawings, a bench according to a preferred embodiment of the present invention is illustrated, wherein the bench is illustrated as an indoor bench. In particular, the bench of the present invention serves as a bedroom bench for incorporating with a bed frame 10 having a headboard 11. Accordingly, the bench comprises a base frame 20 and a back frame 30.

The base frame 20 comprises a seat frame 40 and a leg frame 50 downwardly extended from the seat frame 40.

The seat frame 40 comprises a seat supporting panel 41, a seat cushion 42 overlapped on the seat supporting panel, and a top enclosing layer 43 that wraps the seat cushion 42 on the seat supporting panel 41. As shown in FIG. 2, the seat supporting panel 41 is made of rigid material, such as wood panel, and has a top side and a bottom side. The seat cushion 42 is placed on the top side of the seat supporting panel 41, such that a user is able to sit on the seat frame 40 comfortably. The top enclosing layer 43 wraps the seat cushion 42 on the top side of the seat supporting panel 41 and affixes to the bottom side of the seat supporting panel 41. It is worth mentioning that a width of the seat frame 40 matches with a width of the bed frame 10, such that the bench of the present invention can be placed at a foot end of the bed frame 10 to serve as the bedroom bench. It is worth mentioning that the bench of the present invention can be placed in any other desired location in the room.

The leg frame 50 comprises a plurality of supporting legs 51, preferably four supporting legs 51, spacedly and downwardly extended from the bottom side of the seat supporting panel 41 at corner portions thereof respectively.

The back frame 30 is upwardly extended from the seat frame 30. In particular, the back frame 30 is upwardly and perpendicularly extended from a rear portion of the seat frame 40, wherein a shape of the back frame 30 matches with a shape of the headboard 11 of the bed frame 10. Accordingly, an ornamental design of the back frame 30 matches with an ornamental design of the headboard 11 of the bed frame 10, so as to enhance an aesthetic appearance of the bench which serves as the bedroom bench.

As shown in FIG. 2, the back frame 30 comprises a back supporting panel 30 upwardly extended from the seat frame 40, a back cushion 32 overlapped on the back supporting panel 31, and a back enclosing layer 33 that wraps the back cushion 32 at the back supporting panel 31. Accordingly, the back supporting panel 31 is made of rigid material, such as wood panel, and has a front side and a rear side. The back cushion 32 is placed at the front side of the back supporting panel 31, such that a user's back is able to support via the back frame 40 comfortably. The back enclosing layer 33 wraps the back cushion 32 on the front side of the back supporting panel 31 and affixes to the rear side of the back supporting panel 31. It is worth mentioning that the width of the seat frame 40 matches with a width of the back frame 30.

Figure 3:
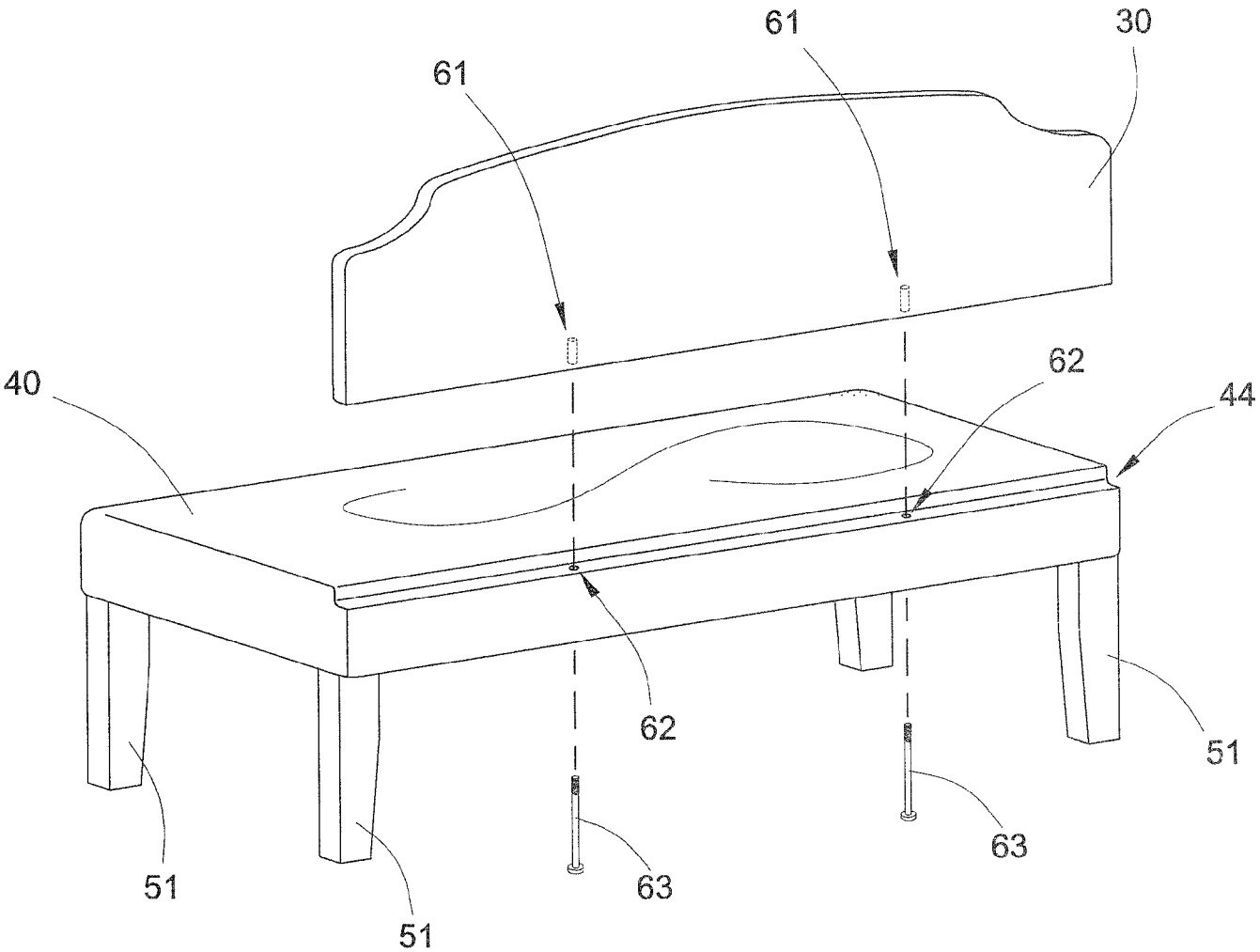
FIG. 3 is an exploded perspective view of the bench according to the above preferred embodiment of the present invention.

According to the preferred embodiment, a bottom edge of the back supporting panel 31 of the back frame 30 is upwardly and perpendicularly coupled with a rear edge of the seat supporting panel 41 of the seat frame 40. In particular, the back frame 30 is coupled with the seat frame 40 via a fastening unit 60, as shown in FIGS. 2 and 3.

The fastening unit 60 has a plurality of threaded slots 61 spacedly formed at the bottom edge of the back supporting panel 31, and a plurality of guiding slots 62 spacedly formed at the rear edge of the seat supporting panel 41. The threaded slots 61 are formed at the bottom edge of the back supporting panel 31 and are extended upwardly to define a plurality of threaded slot openings at the bottom edge of the back supporting panel 31. The guiding slots 62 are through slots extended from the bottom side of the seat supporting panel 41 to the top side thereof, such that when the bottom edge of the back supporting panel 31 is supported on the top side of the seat supporting panel 41 at the rear edge thereof, the guiding slots 62 are aligned with the threaded slots 61 respectively.

The fastening unit 60 further comprises a plurality of fasteners 63 rotatably engaged with the threaded slots 61 through the guiding slots 62 respectively to couple the back frame 30 with the seat frame 40, each of the fasteners 63 is extended from a bottom of the seat frame 40 to rotatably engage with the threaded slots 61 through the guiding slots 62 to couple the back frame 30 with the seat frame 30. Accordingly, each of the fasteners 63, which is preferably a bolt, has an enlarged head and an elongated threaded end, wherein the threaded end of the fastener 63 passes through the guiding slot 62 to engage with the threaded slot 61 until the enlarged head of the fastener 63 biases against the bottom side of the seat supporting panel 41.

According to the preferred embodiment, a width of the seat cushion 42 is shorter than a width of the seat supporting panel 41 to form a receiving notch 44 at the rear edge of the seat supporting panel 41 when a front edge of the seat cushion 42 is aligned with a front edge of the seat supporting panel 41. The bottom edge of the back supporting panel 31 is received along the receiving notch 44. In other words, the bottom edge of the back supporting panel 31 is coupled on the top side of the seat supporting panel 41 without pressing on the seat cushion 42.

Accordingly, the base frame 20 can be manufactured as a universal frame that only matches with the size of the bed frame 10. For example, the width of the base frame 20 is made to match with the queen sized bed frame 10. The back frame 30 can be selectively affixed to the base frame 20 via the fastening unit 60. In other words, by matching the ornamental design of the back frame 30 with the ornamental design of the headboard 11 of the bed frame 10, the back frame 30 is then affixed to the base frame 20. In other words, the base frame 20 can incorporate with different shapes of the back frames 30 as long as the back frame 30 matches with the headboard 11 of the bed frame 10, so as to reduce the overall manufacturing cost of the bench to match with the bed frame 10.

Figure 4:
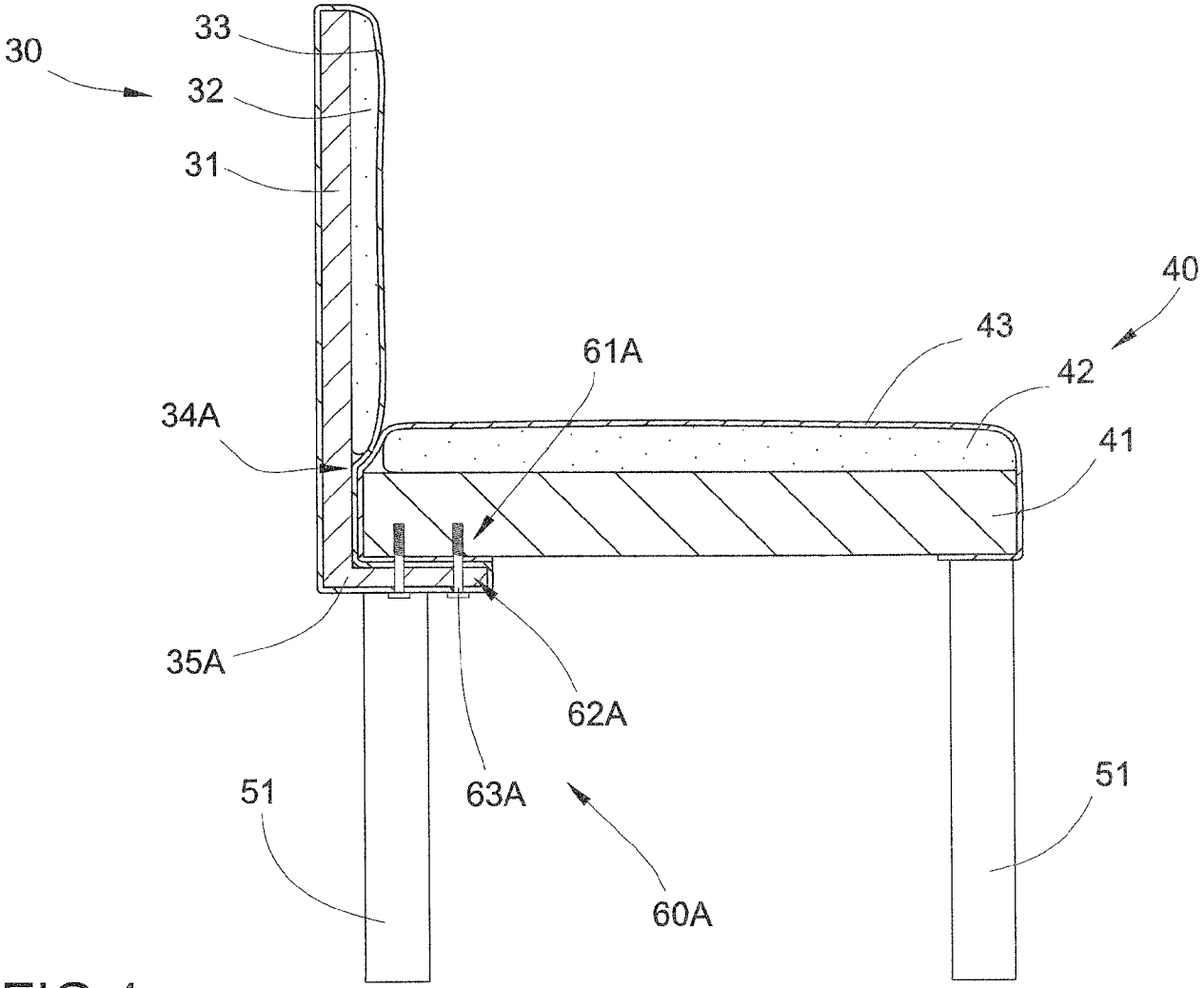
FIG. 4 illustrates an alternative attachment of the bench according to the above preferred embodiment of the present invention.

FIG. 4 illustrates an alternative mode of the bench, wherein the back frame 30A further comprises a coupling panel 35A extended from the bottom edge of the back supporting panel 31 to couple at the bottom of the seat frame 40. In other words, the coupling panel 35A is frontwardly extended from the bottom edge of the back supporting panel 31 to form a L-shaped configuration.

The fastening unit 60A comprises a plurality of threaded slots 61A spacedly formed at the bottom side of the seat supporting panel 41 and a plurality of guiding slots 62A spacedly formed at the coupling panel 35A to align with the threaded slots 61A respectively. The threaded slots 61A are formed at the bottom side of the seat supporting panel 41 and are extended upwardly to define a plurality of threaded slot openings at the bottom side of the seat supporting panel 41.

The guiding slots 62A are through slots extended from the bottom side of the coupling panel 35A to the top side thereof, such that when the coupling panel 35A is coupled at the bottom side of the seat supporting panel 41 at the rear edge thereof, the guiding slots 62A are aligned with the threaded slots 61A respectively.

The fastening unit 60A further comprises a plurality of fasteners 63A rotatably engaged with the threaded slots 61A through the guiding slots 62A to couple the back frame 30A with the seat frame 40. Accordingly, each of the fasteners 63A, which is preferably a bolt, has an enlarged head and an elongated threaded end, wherein the threaded end of the fastener 63A passes through the guiding slot 62 to engage with the threaded slot 61A until the enlarged head of the fastener 63A biases against the bottom side of the coupling panel 35A to overlap under the seat supporting panel 41.

Accordingly, a width of the back cushion 32 is shorter than a width of the back supporting panel 31 to form a receiving notch 34A at the bottom portion of the back supporting panel 31 when a top edge of the back cushion 32 is aligned with a top edge of the back supporting panel 31. The rear edge of the seat supporting panel 41 is received along the receiving notch 34A. In other words, the rear edge of the seat supporting panel 41 is coupled on the front side of the back supporting panel 31 without pressing on the back cushion 32.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A bench for a bed frame, the bed frame having a headboard and a back frame, comprising:

a base frame which comprises a seat frame and a leg frame downwardly extended from said seat frame, wherein the back frame is coupled with the base frame, wherein the back frame upwardly extended from said seat frame, wherein said back frame comprises a back support panel upwardly extended from said seat frame and has a shape of the back frame matches with a shape of the headboard of the bed frame, wherein a bottom edge of said back supporting panel of said back frame is upwardly and perpendicularly coupled with a rear edge of said seat frame, wherein said back frame further comprises a coupling panel extended from said bottom edge of said back supporting panel to couple at a bottom of said seat frame.

2. A bench for a bed frame, the bed frame having a headboard and a back frame, comprising:

a base frame which comprises a seat frame and a leg frame downwardly extended from said seat frame, wherein the back frame is coupled with the base frame, wherein the back frame upwardly extended from said seat frame, wherein said back frame comprises a back support panel upwardly extended from said seat frame and has a shape of the back frame matches with a shape of the headboard of the bed frame, wherein said back support panel of said back frame is upwardly and perpendicularly extended from a rear portion of said seat frame and said seat frame comprises a seat supporting panel, wherein a bottom edge of said back supporting panel of said back frame is upwardly and perpendicularly coupled with a rear edge of said seat frame, wherein said back frame further comprises a coupling panel extended from said bottom edge of said back supporting panel to couple at a bottom of said seat frame.

3. A bench for a bed frame, the bed frame having a headboard and a back frame, comprising:

a base frame which comprises a seat frame and a leg frame downwardly extended from said seat frame, wherein the back frame is coupled with the base frame, wherein the back frame upwardly extended from said seat frame, wherein said back frame comprises a back support panel upwardly extended from said seat frame and has a shape of the back frame matches with a shape of the headboard of the bed frame, wherein a bottom edge of said back supporting panel of said back frame is upwardly and perpendicularly coupled with a rear edge of said seat frame, wherein said back frame further comprises a coupling panel extended from said bottom edge of said back supporting panel to couple at a bottom of said seat frame, and a fastening unit for coupling said back frame with said seat frame, wherein said fastening unit comprises a plurality of threaded slots spacedly formed at a bottom side of said seat supporting panel, a plurality of guiding slots spacedly formed at said coupling panel to align with said threaded slots respectively, and a plurality of fasteners rotatable engaged with said threaded slots through said guiding slots to couple said back frame with said seat frame.

4. A bench for a bed frame, the bed frame having a headboard and a back frame, comprising:

a base frame which comprises a seat frame and a leg frame downwardly extended from said seat frame, wherein the back frame is coupled with the base frame, wherein the back frame upwardly extended from said seat frame, wherein said back frame comprises a back support panel upwardly extended from said seat frame and has a shape of the back frame matches with a shape of the headboard of the bed frame, wherein said back support panel of said back frame is upwardly and perpendicularly extended from a rear portion of said seat frame and said seat frame comprises a seat supporting panel, wherein a bottom edge of said back supporting panel of said back frame is upwardly and perpendicularly coupled with a rear edge of said seat frame, wherein said back frame further comprises a coupling panel extended from said bottom edge of said back supporting panel to couple at a bottom of said seat frame, and a fastening unit for coupling said back frame with said seat frame, wherein said fastening unit comprises a plurality of threaded slots spacedly formed at a bottom side of said seat supporting panel, a plurality of guiding slots spacedly formed at said coupling panel to align with said threaded slots respectively, and a plurality of fasteners rotatably engaged with said threaded slots through said guiding slots to couple said back frame with said seat frame.

5. A bench for a bed frame, the bed frame having a headboard and a back frame, comprising:

a base frame which comprises a seat frame and a leg frame downwardly extended from said seat frame, wherein the back frame is coupled with the base frame, wherein the back frame upwardly extended from said seat frame, wherein said back frame comprises a back support panel upwardly extended from said seat frame and has a shape of the back frame matches with a shape of the headboard of the bed frame, wherein said back support panel of said back frame is upwardly and perpendicularly extended from a rear portion of said seat frame and said seat frame comprises a seat supporting panel, wherein a bottom edge of said back supporting panel of said back frame is upwardly and perpendicularly coupled with a rear edge of said seat frame, wherein said back frame further comprises a coupling panel extended from said bottom edge of said back supporting panel to couple at a bottom of said seat frame, and a fastening unit for coupling said back frame with said seat frame, wherein said fastening unit comprises a plurality of threaded slots spacedly formed at a bottom side of said seat supporting panel, a plurality of guiding slots spacedly formed at said coupling panel to align with said threaded slots respectively, and a plurality of fasteners rotatably engaged with said threaded slots through said guiding slots to couple said back frame with said seat frame, wherein an ornamental design of said back frame matches with an ornamental design of the headboard of the bed frame.

* * * * *